US006915923B1

(12) United States Patent
Magid

(10) Patent No.: US 6,915,923 B1
(45) Date of Patent: Jul. 12, 2005

(54) COUPON DISPENSER

(75) Inventor: Edward Magid, Ivyland, PA (US)

(73) Assignee: Floorgraphics, Inc., Princeton, NJ (US)

( * ) Notice: Subject to any disclaimer, the term of this patent is extended or adjusted under 35 U.S.C. 154(b) by 2 days.

(21) Appl. No.: 10/705,621

(22) Filed: Nov. 10, 2003

(51) Int. Cl.[7] ..... B65H 1/08
(52) U.S. Cl. ..... 221/56; 221/59; 221/61
(58) Field of Search ..... 221/45, 46, 56, 221/59, 61, 63, 65, 279; 211/59.3

(56) References Cited

U.S. PATENT DOCUMENTS

| | | | | | |
|---|---|---|---|---|---|
| 2,464,426 | A | * | 3/1949 | Williams | 221/58 |
| 3,425,595 | A | * | 2/1969 | Shapira | 221/52 |
| 4,416,392 | A | * | 11/1983 | Smith | 221/45 |
| 4,838,454 | A | * | 6/1989 | Salzmann et al. | 221/57 |
| 5,143,250 | A | * | 9/1992 | Freitag | 221/59 |
| 6,585,129 | B2 | * | 7/2003 | Moody et al. | 221/44 |

* cited by examiner

*Primary Examiner*—David H. Bollinger
(74) *Attorney, Agent, or Firm*—Armand M. Vozzo, Jr.

(57) ABSTRACT

An improved coupon dispenser is disclosed comprising a rigid housing assembly that includes a front cover and a mating rear housing section engaged together to provide a storage chamber for a stack of folded coupon sheets. The front cover is provided with a rounded dispensing mouth having a rectangular opening formed therein between upper and lower panel surfaces that extend across the mouth in separate inclined planes. The front cover is further provided with a plurality of internal ribs integrally formed and extending longitudinally through the chamber on all sides, the ribs along the upper chamber being curved and tapered at the dispensing mouth leading to the opening. A P-shaped pusher member engaged to the rear housing section and mounted on a coil spring is disposed for travel longitudinally through the chamber of the front cover to urge the coupons forwardly toward the opening in the dispensing mouth guided along by the internal ribs. The coupon dispenser may be mounted upon a store shelf or other like surface at a point of consumer purchase.

15 Claims, 7 Drawing Sheets

COUPON DISPENSER

BACKGROUND OF THE INVENTION

The present invention relates to devices used to dispense retail promotions, such as product or price coupons, in individual sheets at a point-of-purchase, and more particularly to an improved coupon dispenser device wherein a spring-loaded pusher member formed having a P-shaped head is mounted for linear travel within the chamber of a rigid housing assembly having a rounded dispensing mouth and a plurality of tapered ribs extending longitudinally through the chamber to guide distribution and delivery of a stack of coupons to the dispensing mouth when urged upon by the pusher member.

In the field of retail marketing and store promotions, the use of coupon dispensers is widespread particularly at the point of consumer selection and purchase of the product. Often mounted on retail shelves in proximity to the associated product, these coupon dispensers have traditionally been mechanical or electro-mechanical in their operation and have been designed in a variety of configurations to deliver a supply of stored coupons one at a time to an interested consumer. The coupons are generally stored in a folded stack within box-like housings and spring pressure is often applied to the stack to maintain a certain directional distribution, typically toward an open end in the housing through which the coupons may be individually retrieved. Ideally, the stack of coupons should move smoothly through the housing of the dispenser with the outermost coupon in the stack being exposed through the open end so that one and only one coupon is delivered at a time.

Many prior art coupon dispenser devices have been devised and constructed in an effort to provide a complete and continuous flow of the coupons stored therein and their repetitive delivery one-at-a-time to the consumer. Structure variations in the housing of these prior art devices have been implemented in an attempt to facilitate the storage and flow of the coupon stack under a spring load. Other adaptations, such as the use of specially interfolded coupon sheets, with and without adhesive backings, have also been used with some success to achieve a more consistent distribution and sequential delivery of the coupons. While a wide variety of pre-existing dispenser devices with spring-loaded coupon stacks have been generally satisfactory in their use, they have not proven to be completely reliable in effecting repeatable discharge of a single coupon without clumping many together. Although battery powered coupon dispensing devices having electro-mechanical advancers have been proven capable of delivering individual coupons in sequence, they are generally more expensive and burdensome to mount and can be prone to failure due to their power requirements and mechanical movements.

SUMMARY OF THE INVENTION

Accordingly, it is a general purpose and object of the present invention to provide an improved device for dispensing coupons to consumers at a point of purchase.

A more particular object of the present invention is to provide an improved coupon-dispensing device capable of holding a stack of coupons and delivering each coupon in the stack sequentially and one at a time for consumer use at a point of purchase.

Another object of the present invention is to provide a coupon dispenser that houses a stack of coupons under a spring load specially applied for a more controlled distribution and positive delivery of the coupons throughout the device.

Still another of the present invention is to provide a coupon dispenser that is reliable in its delivery of coupons one at a time and made to resist jamming or clumping of the coupons.

A still further object of the present invention is to provide a reusable coupon dispenser that is sturdy in its construction, easy to assemble and readily mounted to storage shelves.

Briefly, these and other objects of the present invention are accomplished by an improved coupon dispenser comprising a rigid housing assembly that includes a front cover and a mating rear housing section engaged together to provide a storage chamber for a stack of folded coupon sheets. The front cover is provided with a rounded dispensing mouth having a rectangular opening formed therein between upper and lower panel surfaces that extend across the mouth in separate inclined planes. The front cover is further provided with a plurality of internal ribs integrally formed and extending longitudinally through the chamber on all sides, the ribs along the upper chamber being curved and tapered at the dispensing mouth leading to the opening. A P-shaped pusher member engaged to the rear housing section and mounted on a coil spring is disposed for travel longitudinally through the chamber of the front cover to urge the coupons forwardly toward the opening in the dispensing mouth guided along by the internal ribs. The coupon dispenser may be mounted upon a store shelf or other like surface at a point of consumer purchase.

For a better understanding of these and other aspects of the present invention, reference should be made to the following detailed description taken in conjunction with the accompanying drawings in which like reference numerals and characters designate like parts throughout the figures thereof.

BRIEF DESCRIPTION OF THE DRAWINGS

For a fuller understanding of the nature and object of the present invention, references in the detailed description of the preferred embodiment set forth below shall be made to the accompanying drawings in which.

DETAILED DESCRIPTION OF THE INVENTION

The following is a detailed description of a preferred embodiment of the present invention and the best presently contemplated mode of its production and practice. This description is further made for the purpose of illustrating the general principles of the invention but should not be taken in a limiting sense, the scope of the invention being best determined by reference to the appended claims.

Figure 1:
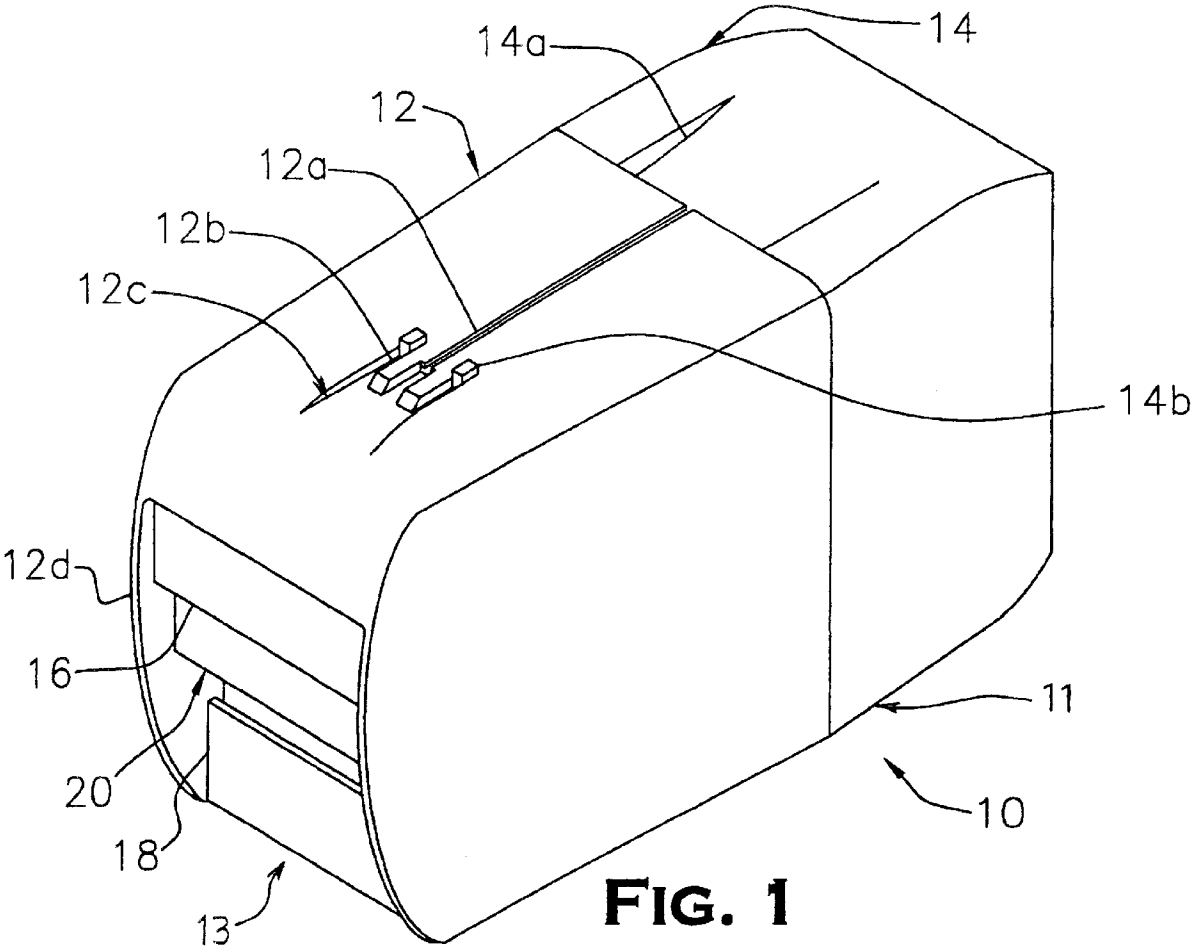
FIG. 1 is a front perspective view of a coupon dispenser device made in accordance with the present invention.

Referring now to the drawings and particularly to FIG. 1, the coupon dispenser of the present invention, generally designated 10, is shown in assembled state and ready to deliver one of a plurality of coupon sheets 20 or other piece of promotional material for retrieval by a consumer at a point-of-purchase location. Described in somewhat greater detail below, the coupon sheets 20 are generally rectangular in form and stacked together within the coupon dispenser 10, each sheet being typically folded in a Z-like configuration having a forward-facing leading flap and a rearward-facing trailing flap with a central panel therebetween. The coupon dispenser 10 features a rigid housing assembly 11 including a front cover section 12 and a rear housing section 14 that are releasably engaged and joined together at respective facing edges to provide a continuous housing body with longitudinal chamber therethrough. The front cover 12 and rear housing 14 are each made of a lightweight and durable material, such as plastic, and are formed, typically by conventional molding, having substantially the same cross-sectional dimensions at their respective facing edges. The exterior of the housing assembly 11 typically presents a rounded rectangular box-like structure, as shown, but can be otherwise formed in a variety of external configurations within the scope of the present invention. Regardless of its external configuration, a rounded dispensing mouth 13, described in greater detail below, is formed and provided at the front end of the housing assembly 11 to ensure the proper delivery and retrieval of individual coupon sheets 20 stored within the chamber of the housing assembly.

Engagement of the front cover 12 and rear housing section 14 is releasable and effected by means of an interlocking arrangement of their respective top and bottom surfaces. To this effect, the top surface of front cover 12 is provided with a central slot 12*a* extending forward from the rear facing edge and a pair of slotted openings 12*b* of rectangular configuration made through the top surface on either side of the central slot near the forwardmost end of the slot. A recess section 12*c* is further formed in the top surface of the front cover 12 forwardly of the central slot 12*a* and slotted openings 12*b* to provide a flattened central region on the top of the housing assembly 11. As better seen in FIG. 3, an additional pair of slotted openings 12*g*, like those openings 12*b* on the top of the front cover 12, are formed in the bottom surface of the front cover to cooperate with associated portions of the rear housing section 14, described in greater detail below, in further support of the releasable engagement feature of the housing assembly 11. It should be noted that the central slot 12*a* through the top surface of the front cover 12 provides an element of needed flexibility for the releasable engagement of the front cover with the rear housing section 14 and further allows for the placement of a promotional card or marquee (not shown) along the top of the housing assembly 11 and resting forwardly upon the recess section 12*c*.

The rear housing section 14 is formed along its respective top and bottom surfaces with flexible tangs 14*a* and 14*c* each made to extend into the open back end of the front cover 12 and engage with the respective pairs of slotted openings 12*b* and 12*g* in the top and bottom surfaces thereof. Upper tang 14*a*, seen most clearly in FIGS. 3 and 5, projects from the top surface of the rear housing section 14 and is made so as to permit inward deflection, further having a pair of raised detents 14*b* provided at the end of the tang that are directed outward and positioned so as to engage the slotted openings 12*b* on the top of front cover 12. Lower tang 14*c*, also viewed clearly in FIGS. 3 and 5, projects from the bottom side of the rear housing section 14 and like upper tang 14*a*, is made to permit its inward deflection, having a pair of raised detents 14*d* spaced apart and outwardly directed at the end of the lower tang so as to engage the slotted openings 12*g* in the bottom of the front cover 12. Housing assembly 11 is thus joined and held together by the full forward extension of the respective upper and lower tangs 14*a* and 14*c* into the back of the front cover 12 and the resulting engagement of their associated detents 14*b* and 14*d* with the respective pairs of slotted openings 12*b* and 12*g* in the top and bottom of the front cover. Subsequent release of that slotted engagement and the separation of the front cover 12 and rear housing section 14 may then be effected by depressing the upper tang 14*a* and lower tang 14*c* and deflecting them inwardly and toward each other to allow both tangs and their respective detents 14*b* and 14*d* to be withdrawn rearwardly from the front cover.

Figure 2:
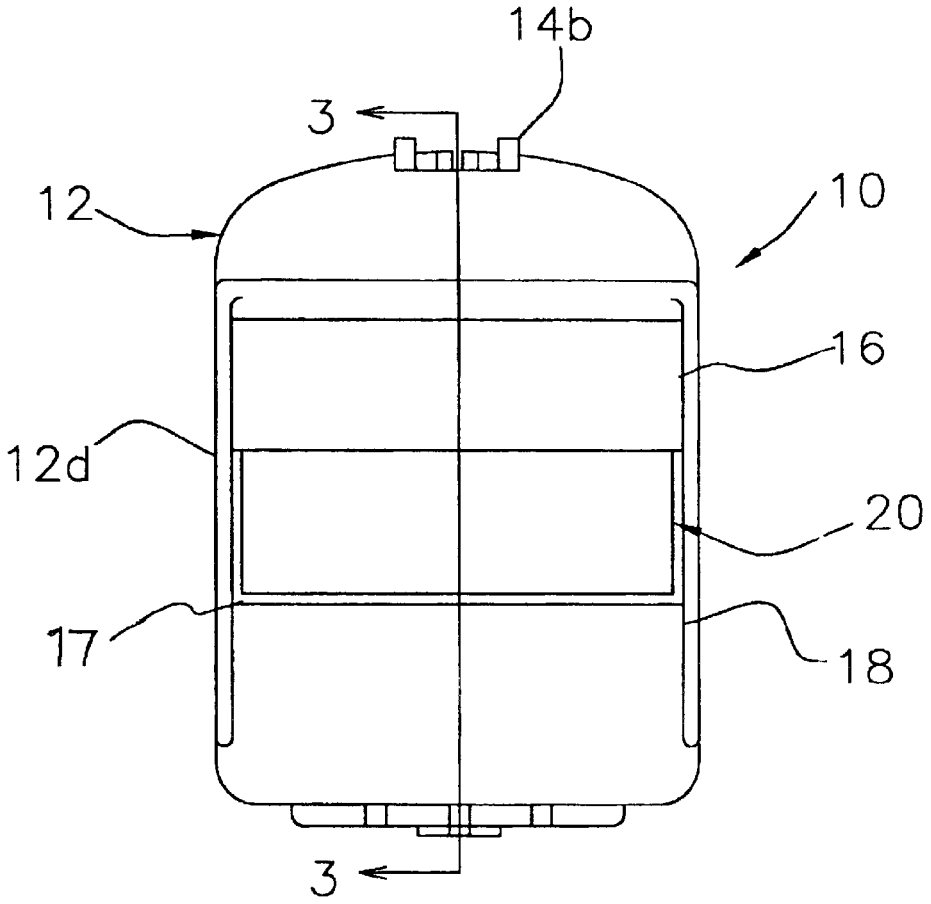
FIG. 2 is a front elevation view of the coupon dispenser shown in FIG. 1.
Figure 3:
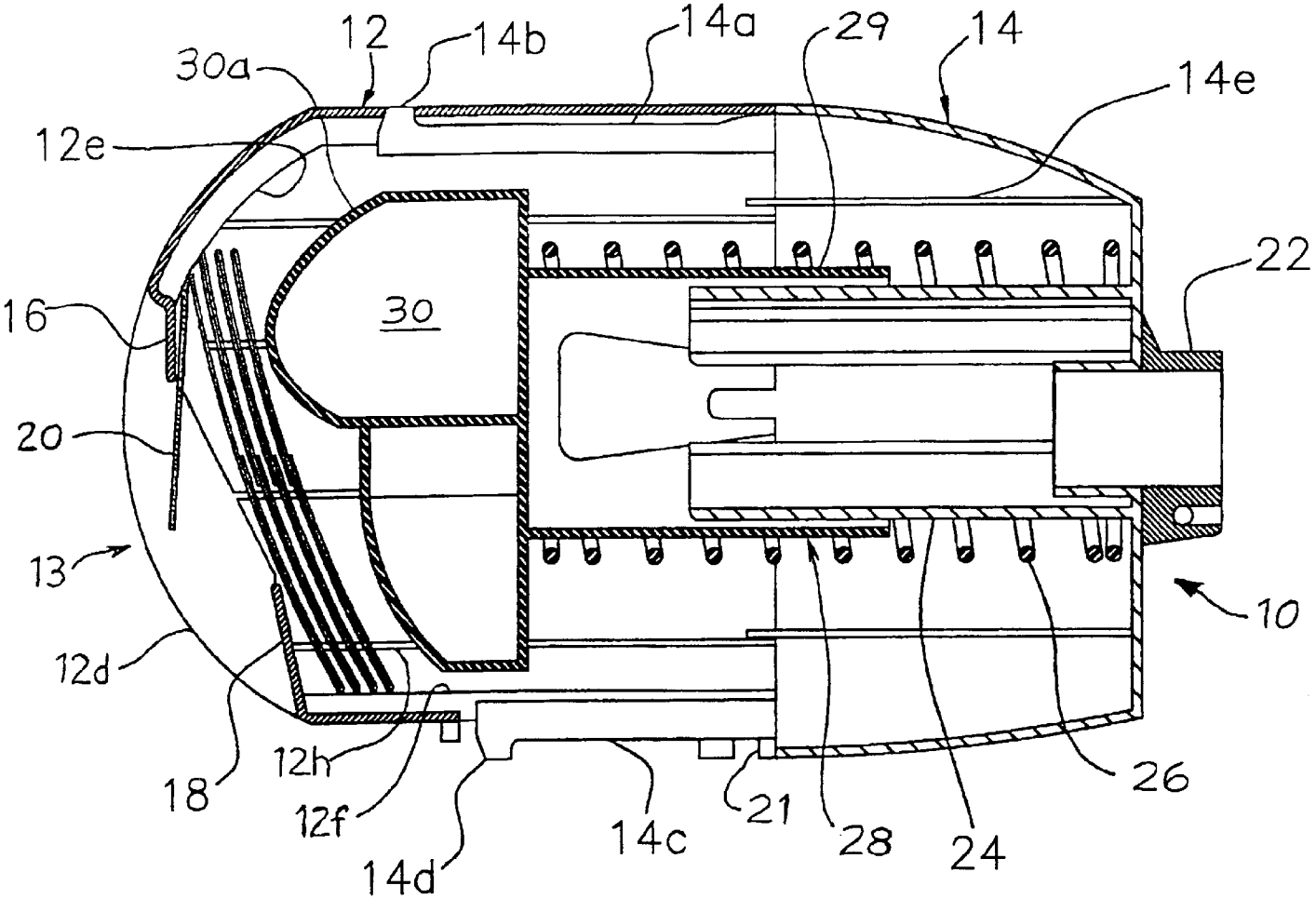
FIG. 3 is a sectional view of the present coupon dispenser taken along the line 3—3 in FIG. 2.
Figure 7:
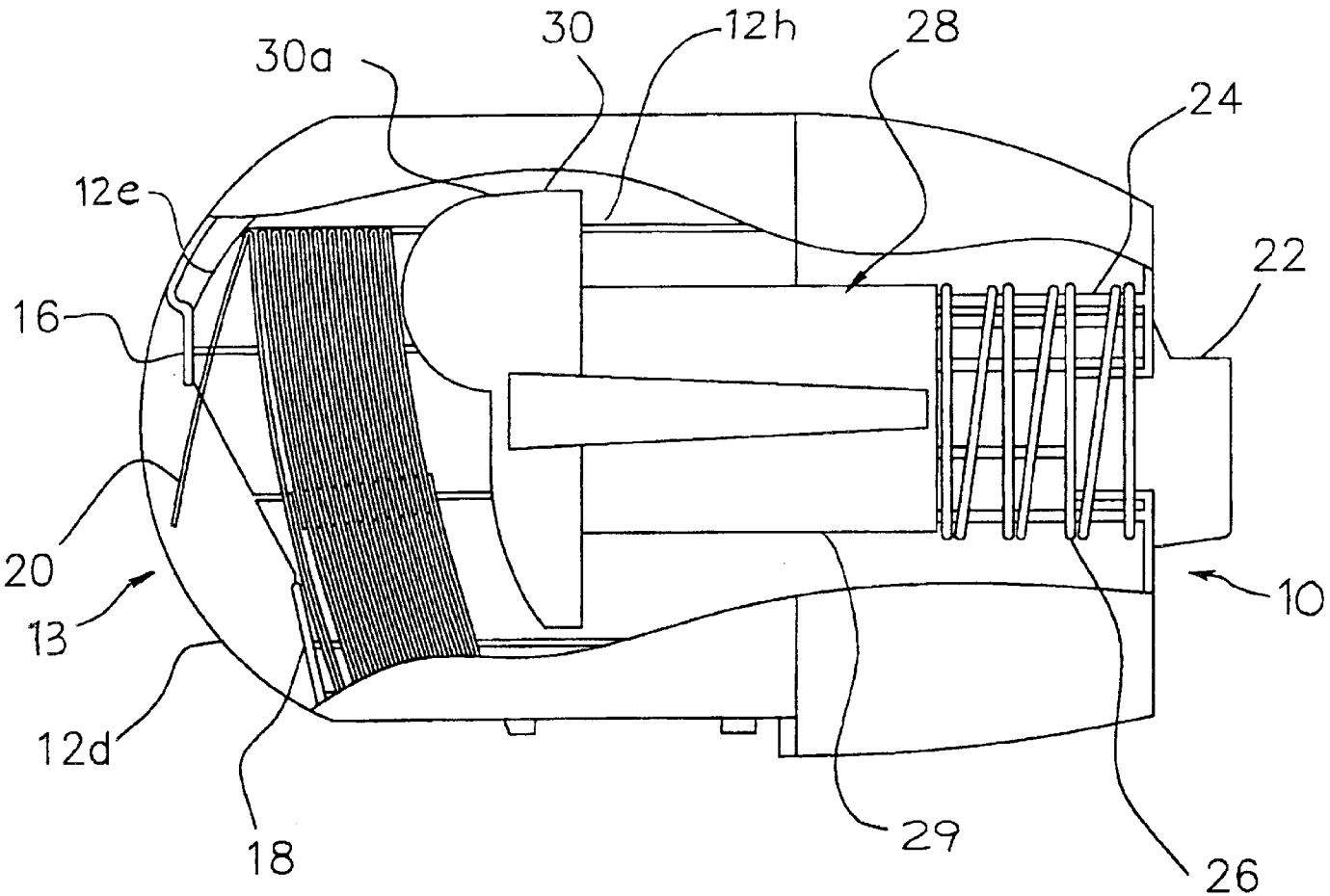
FIG. 7 is a side view of the present coupon dispenser with a portion cutaway to present an internal view of the invention in operation.

Referring now to FIG. 2 in conjunction with FIG. 1, the dispensing mouth 13 found at the front end of housing assembly 11 is formed having a central opening 17 substantially rectangular in its outline and made to extend substantially across the forward face of front cover 12. An upper panel member 16 integrally formed across the forward face of the front cover 12 is disposed downwardly in a plane substantially perpendicular to the top of the front cover to establish the top edge of the central opening 17. A lower panel 18, also integrally formed across the forward face of front cover 12 but across the bottom thereof, is disposed inwardly from the upper panel member 16 in a separate plane that is recessed from that of the upper panel and inclined slightly forward, as best seen in FIGS. 3 and 7, to establish the top edge of the central opening 17. On each side of the upper and lower panel members 16 and 18, rounded edge panels 12*d* are integrally formed on the front cover 12 and made to extend forwardly with an arcuate projection beyond the planar positions of both the upper and lower panel members, with the forwardmost projection of the edge panels being located about the central opening 17 on either side thereof. Formation of these rounded edge panels 12*d* protruding on either side of central opening 17 serves to confine access to the dispensing mouth 13 from either side and require the consumer to retrieve the respective outermost coupon sheets 20 in a direct fashion through the opening. In conjunction with the upper panel member 16, the edge panels 12*d* thus work to prevent the removal of coupon sheets 20 from the opening 17 in clumps or groups of multiple sheets.

Figure 4:
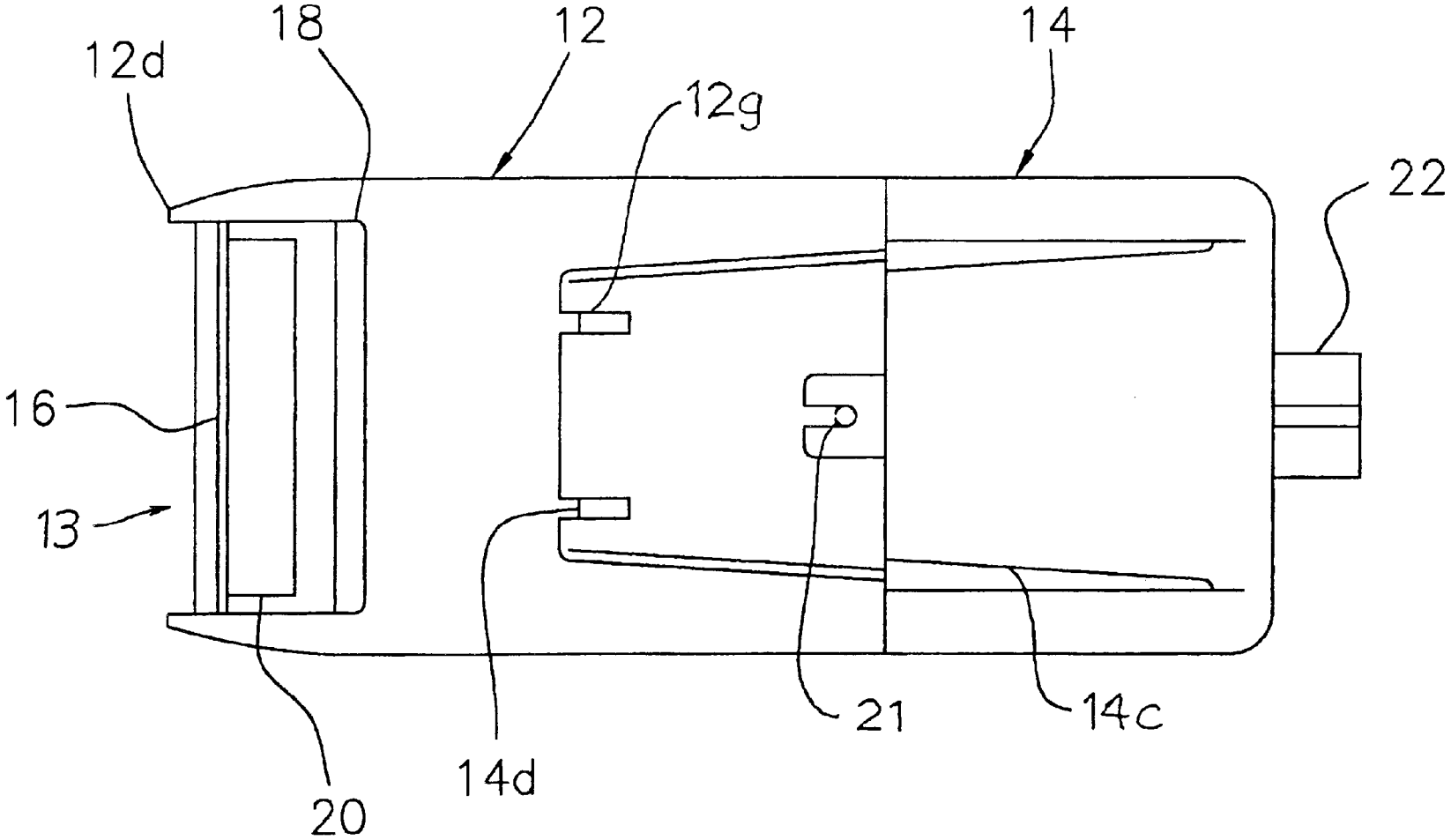
FIG. 4 is a plan view of the bottom of the coupon dispenser of FIG. 1.

As seen more clearly in FIG. 4, the recessed position of the lower panel member 18 relative to the upper panel member 16 further provides a dimension of depth to the central opening 17 in the dispensing mouth 13 of the housing assembly 11. The depth provided to the central opening 17 between the respective upper and lower panel members 16 and 18 allows the outermost coupon sheet 20 to project downwardly and outwardly through the opening in a manner, as seen in both FIGS. 3 and 7, that exposes the leading flap of the coupon sheet like a tongue. This tongue effect produced upon the outermost coupon sheet 20 by the internal working structure of the coupon dispenser 10, described in greater detail below, is instrumental in delivering one and only one coupon sheet at a time to the consumer.

Figure 6:
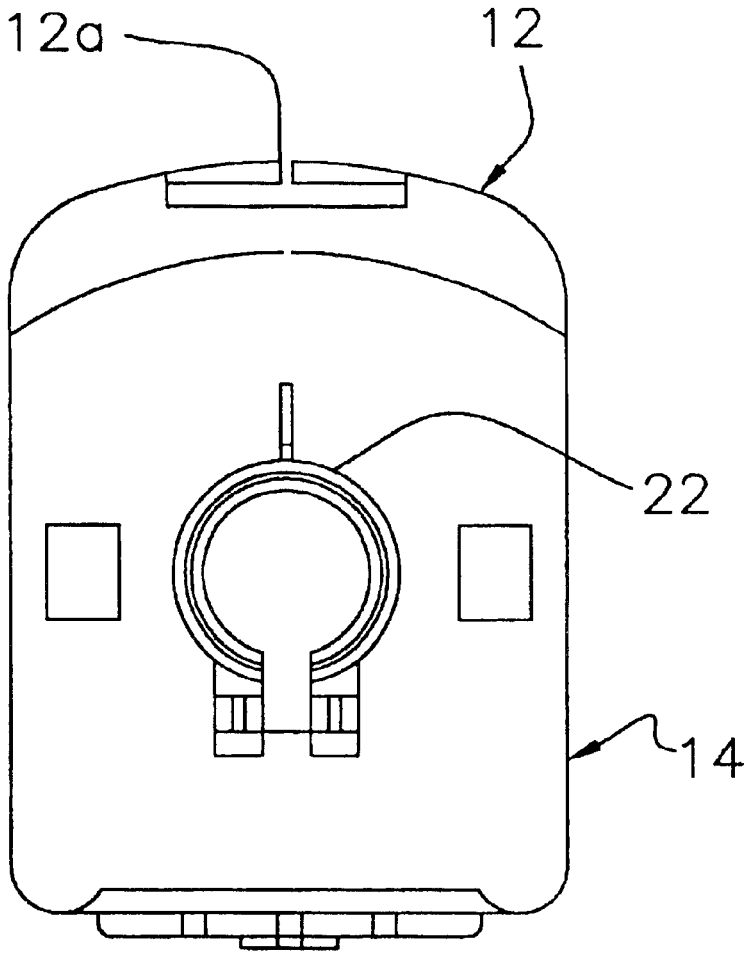
FIG. 6 is a rear elevational view of the coupon dispenser of FIG. 1.

Further seen in FIG. 4, the pair of slotted openings 12*g* on the underside of front cover 12 are positioned rearward of the dispensing mouth 13 about midway toward the rear facing edge of the front cover, one of the openings being on each side of the centerline. The positioning of the slotted openings 12 is coordinated with both the length and width of the lower tang 14*c* on rear housing section 14 so that the raised detents 14*d* on the end of the lower tang align with and engage the slotted opening upon full insertion of the lower tang into the front cover. Further provided on the underside of the front cover 12 along the centerline thereof and rearward of the slotted openings 12*g*, a circular opening 21 is formed through the front cover and made to align with a corresponding opening formed in the lower tang 14*c* so that a screw or other locking member (not shown) may be inserted through the openings when the housing assembly 11 is joined to lock the front cover to the rear housing section 14. A mounting boss 22 integrally formed and made to extend from the back of the rear housing section 14 is provided to permit mounting of the coupon dispenser 10 at a point-of-purchase location. As viewed in FIG. 6, the mounting boss 22 is typically cylindrical in its extended form and thus adapted for engagement by a mating cylindrical rod or like coupling member (not shown) to secure the coupon dispenser 10 in a proper and substantially horizontal position.

Figure 5:
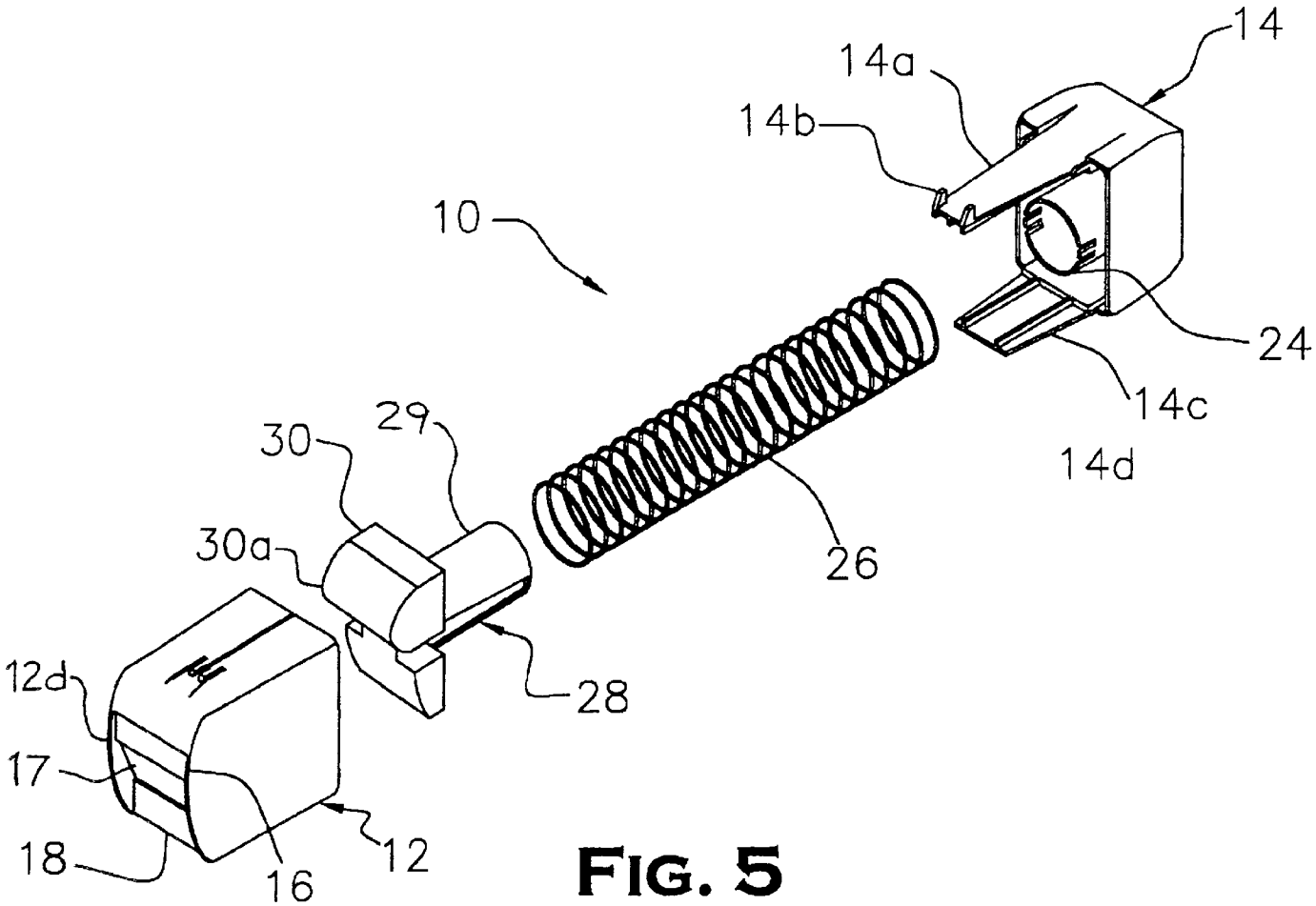
FIG. 5 is an exploded perspective view of the coupon dispenser shown in FIGS. 1–4.

Referring now to FIGS. 3 and 5, the operative components and internal structure of the present coupon dispenser 10 include a pusher member 28 having a substantially P-shaped head 30 mounted within housing assembly 11 for longitudinal travel therethrough. The pusher member 28 is made of a rigid and durable material similar to that of the housing assembly 11 and is formed having a cylindrically-shaped rear body 29 that extends from the back of the P-shaped head 30 in an axial direction. The rear body 29 of the pusher member 28 is adapted to engage a cylindrical core 24 projecting forward from within the rear housing section 14, the cylindrical form of the rear body being sized in its diameter to fit over and along the form of the core. Flexible key members 24*a* made to project on either side of the core 24 are adapted to engage longitudinal openings on opposite sides of the rear body 29 so as to retain the movable pusher member 28 to the core of rear housing section 14 and help guide longitudinal travel of the pusher member through the housing assembly 11 without rotation. A coil compression spring 26 having a generally cylindrical configuration is formed to fit along its axis within the rear body 29 of the pusher member 28 and further extend into the central core 24 of the rear housing section 14 to abut the inside back wall thereof. The coil spring 26 thus disposed between the pusher member 28 and the rear housing section 14 is contained within the rear body 29 of the pusher member and the central core 24 of the rear housing section to produce a forwardly directed spring force upon the pusher member. The engagement of the rear body 29 of the pusher member with the central core 24 via key members 24*a* confines the coil spring 26 between the pusher member 28 and the rear housing section 14 and allows those engaged components to be separated and handled together in combination apart from the front cover 12.

The P-shaped head 30 of pusher member 28 is formed having a curved front surface 30*a* that is asymmetric in its curved configuration, the upper portion of the front surface having a substantially semi-circular profile and the bottom portion having a less pronounced convex profile with a relatively larger radius of curvature. The P-shaped head 30 is disposed at the forward end of the pusher member 28 with its curved front surface 30*a* directed toward the dispensing mouth 13 of the housing assembly 11 when mounted internally thereof. Thus disposed, the curved front surface 30*a* of the P-shaped head 30 is set to immediately impact and press against the stack of coupon sheets 20 loaded within the chamber of the housing assembly 11, particularly within the forward section of front cover 12, and apply to the coupon stack the forwardly directed spring tone of the coil spring 26.

The stack of folded coupon sheets 20 is loaded into the front cover 12 from the open rear end thereof and placed therein so that the central panel of each sheet is vertically oriented within the chamber having the forward-facing leading flap at the top and the rearward-facing trailing flap at the bottom. This orientation of the coupon sheets 20 in the chamber of the front cover 12 allows the leading flap to be pressed forward and deflected outward from the central opening 17 upon the urging of the curved face 30*a* of the spring-loaded P-shaped head 30. Preferable to the operation of the present coupon dispenser 10, the leading flap of each of the coupon sheets 20 may be made disproportionately longer than the trailing flap to promote a greater forward deflection of the coupon stack by the P-shaped head 30 and produce a more pronounced tongue effect exhibited by the leading flap of the outermost coupon sheet.

The chamber of the housing assembly 11 is ribbed in its construction along the entire assembled length thereof and on all surrounding walls. The inside top wall of the front cover 12 is provided with a series of contoured ribs 12*e* that extend forward from the open rear end of the front cover initially level with the top wall and then curving downward toward the central opening 17 of the dispensing mouth 13 with a radius of curvature substantially the same as that of the rounded edge panels 12*d*. Each of the contoured ribs 12*e* is tapered slightly as it approaches the central opening 17, particularly as the curved portion of each rib meets the inside surface of the upper panel member 16 above the central opening. These contoured ribs 12*e* in their described curved and tapered form serve to guide the movement of the coupon sheets 20, funneling the sheets downward toward the central opening 17 when pressed upon and urged forwardly by the P-shaped head 30. Additional bottom ribs 12*f* and side ribs 12*h*, each running substantially level to the respective bottom and side walls of the front cover 12, extend along the respective walls of the chamber to supplement the contoured ribs 12*e* and complete the surrounding ribbed construction of the chamber. This surrounding ribbed construction integrally provided along the chamber of the front cover 12 not only strengthens the structural shell of the front cover but also serves to contain therein and directly support the stack of coupon sheets along the edges of the separate ribs and thereby provide low friction guidance to the stack in its distribution through the housing assembly 11 and into the dispensing mouth 13. Within the rear housing section 14, a plurality of side ribs 14*e* are further formed along the side walls and made to extend from the back of the rear housing section through the open front end thereof. These side ribs 14*e* correspond in number to the side ribs 12*h* in the front cover 12 and are substantially aligned with the side ribs in the front cover when the rear housing section is assembled thereto. Each of the side ribs 14*e* is made to extend just beyond the open front end of the rear housing section 14 to further provide corresponding projections around the forward perimeter of the housing section that serve to align it with the front cover during assembly. The respective upper and lower tangs 14*a* and 14*c* are also ribbed along their inner wall surfaces to align and blend with the corresponding ribs 12*e* and 12*f* on the top and bottom surfaces of the front cover 12 when assembled to the rear housing section 14.

Referring now to FIG. 7, the stack of coupon sheets 20 are loaded into the ribbed chamber of the front cover 12 through its open rear end and held in position within the chamber surrounded by and supported along the internal ribs 12*e*, 12*f* and 12*h*. Upon assembling the combined rear housing section 14 and spring-loaded pusher member 28 to the front cover 12, the loaded stack of coupon sheets 20 is urged forward and deflected in a bowed manner under the force of the coil spring 26 that is applied to the rear of the stack by the P-shaped head 30 of the pusher member 28. The bowed deflection of the stack of coupon sheets 20 is the result of the asymmetric curvature of the P-shaped head 30 and the funneling effect provided by the contoured ribs 12*e* and contributes to the tongue effect produced upon the outermost coupon sheet at the central opening 17. The entire stack of coupon sheets 20 is distributed forwardly through the front cover 12 of the housing assembly 11 by the spring-loaded pusher member 28 and is guided continuously through the surrounding ribbed construction of the chamber, the contoured ribs 12*e* along the top wall funneling the upper part of the stack toward the central opening 17 and allowing the leading flap of the outermost coupon sheet to project downward and outward from the opening so that it may be easily reached between the rounded edge panels 12*d* and removed by the consumer from the dispensing mouth 11.

Therefore, it should be apparent that the described invention provides an improved device for dispensing coupons to consumers at a point of purchase. The present invention more particularly provides an improved coupon-dispensing device capable of holding a stack of coupons and delivering each coupon in the stack sequentially and one at a time for consumer use at a point of purchase. The internal structure of the described coupon dispenser, particularly the tapered ribs formed within the chamber of the housing assembly and the spring-loaded P-shaped pusher traveling therethrough, reduces drag on the coupon stack and produces a funneling effect thereon at the dispensing mouth for a more controlled distribution and positive discharge of the coupons. The external structure of the present coupon dispenser, particularly the rounded side panels extending about the opening at the dispensing mouth, promote the sequential delivery of coupons and resist clumping of the coupons by the consumer. In addition, the described coupon dispenser is sturdy and reusable, easy to assemble and readily mounted to storage shelves.

Obviously, other embodiments and modifications of the present invention will readily come to those of ordinary skill in the art having the benefit of the teachings presented in the foregoing description and drawings. Alternate embodiments of different shapes and sizes, as well as substitution of known materials or those materials which may be developed at a future time to perform the same function as the present described embodiment are therefore considered to be part of the present invention. Accordingly, it is understood that this invention is not limited to the particular embodiment described, but rather is intended to cover modifications within the spirit and scope of the present invention as expressed in the appended claims.

What is claimed is:

1. A device for dispensing a stack of coupon sheets each folded having a forwardly leading flap, comprising:

a housing member having a chamber extending longitudinally therethrough to contain the stack of coupon sheets and an opening formed in the front end of said housing member to accept the forwardly leading flap of each sheet, said housing member being further formed having a plurality of longitudinal ribs extending through and surrounding the chamber to guide the stack of coupons toward the opening in the front end of said housing member; and pusher means having a P-shaped head operatively disposed within said housing member for urging the stack of coupon sheets longitudinally through the chamber in a deflected manner guided by the longitudinal ribs so that the forwardly leading flap of the outermost coupon sheet projects outward through the opening.

2. A coupon dispensing device according to claim 1, wherein said housing member comprises:

a front cover having a rounded dispensing mouth formed at the opening of the chamber; and a rear housing section formed to engage said front cover and be releasably connected thereto.

3. A coupon dispensing device according to claim 2, wherein said front cover further comprises:

an upper panel member positioned at the rounded dispensing mouth above the opening and disposed in a first plane;

a lower panel member positioned at the rounded dispensing mouth below the opening and disposed in a second plane recessed from the first plane; and a pair of edge panel members each having a rounded configuration and projecting forwardly on opposite sides of the opening.

4. A coupon dispensing device according to claim 3, wherein the plurality of longitudinal ribs comprise:

a series of first ribs spaced apart along the top of said front cover and extending forwardly to the upper panel member, said first ribs being contoured in their forward extension to conform with the rounded dispensing mouth of said front cover;

a series of second ribs spaced apart along the bottom of said front cover and extending forwardly to the lower panel member; and a series of third ribs spaced apart on either side of said front cover and extending forwardly to opposite sides of the opening.

5. A coupon dispensing device according to claim 1, wherein said pusher means further comprises:

a pusher member operatively mounted within the chamber of said housing member and formed having a cylindrical body extending from the rear of the P-shaped head; and a coil spring formed to fit within the cylindrical body of said pusher member and operatively coupled to said housing member.

6. A coupon dispensing device according to claim 5, wherein the front surface of the P-shaped head is formed having an asymmetric curvature, the upper portion thereof having a substantially semi-circular profile and the bottom portion having a convex profile of larger radius than the upper portion.

7. A coupon dispensing device according to claim 5, wherein said rear housing section comprises:

a pair of tang members extending along the top and bottom of said section to releasably engage the front cover; and a cylindrical core member projecting forwardly from said section, the core member being formed to contain the coil spring of said pusher member and keyed to engage the cylindrical body thereof.

8. A device for dispensing individual sheets of paper each folded having a forwardly facing flap and grouped collectively in a stack, comprising:

housing means having a longitudinal chamber for containing the stack of sheets and a rectangular opening at one end of the chamber to remove the sheets therefrom, the chamber further having a plurality of longitudinal ribs surrounding the chamber and extending therethrough to guide the stack toward the opening; and pusher means having a P-shaped head operatively disposed within the chamber of said housing means for urging the stack of sheets forwardly through the chamber and along the longitudinal ribs in a deflected manner so that the forwardly facing flap of each sheet projects outward through the opening.

9. A dispensing device according to claim 8, wherein said housing means further comprises:

a front cover having a rounded dispensing mouth formed at the rectangular opening of the chamber; and a rear housing section formed to engage said front cover and be releasably connected thereto.

10. A dispensing device according to claim 9, wherein the rounded dispensing mouth of said front cover comprises:

an upper panel member positioned above the rectangular opening and disposed in a first plane;

a lower panel member positioned below the rectangular opening and disposed in a second plane recessed from the first plane; and a pair of edge panel members each having a rounded configuration and projecting on either side of the rectangular opening.

11. A dispensing device according to claim 10, wherein the plurality of longitudinal ribs comprise:

a series of first ribs spaced apart along the top of the chamber and extending to the upper panel member, said first ribs being contoured in their forward extension to conform with the rounded dispensing mouth of said front cover;

a series of second ribs spaced apart along the bottom of the chamber and extending to the lower panel member; and a series of third ribs spaced apart on either side of the chamber and extending to opposite sides of the rectangular opening.

12. A dispensing device according to claim 9, wherein said rear housing section is formed having a pair of tang members extending from the top and bottom thereof to releasably engage the front cover.

13. A dispensing device according to claim 8, wherein said pusher means further comprises:

a pusher member operatively mounted within the chamber of said housing means and formed having a cylindrical body extending from the rear of the P-shaped head; and a coil spring formed to fit within the cylindrical body of said pusher member and operatively coupled to said housing means.

14. A dispensing device according to claim 13, wherein the front surface of the P-shaped head is formed having an asymmetric curvature, the upper portion thereof having a substantially semi-circular profile and the bottom portion having a convex profile of larger radius than the upper portion.

15. A dispensing device according to claim 13, wherein said rear housing section is further formed having a cylindrical core member projecting forwardly therefrom, the core member being formed to contain the coil spring of said pusher member and keyed to engage the cylindrical body thereof.

* * * * *